US012765672B2

(12) United States Patent
Sun et al.

(10) Patent No.: US 12,765,672 B2
(45) Date of Patent: Oct. 20, 2026

(54) MECHANICAL EXTENDING MECHANISM AND CHAIR

(71) Applicant: HAINING HELI MACHINERY & TECHNOLOGY CO., LTD., Jiaxing (CN)

(72) Inventors: Xiqi Sun, Jiaxing (CN); Qiu Xu, Jiaxing (CN); Mengjie Li, Jiaxing (CN); Junjun Dai, Jiaxing (CN)

(73) Assignee: HAINING HELI MACHINERY & TECHNOLOGY CO., LTD., Jiaxing (CN)

( * ) Notice: Subject to any disclaimer, the term of this patent is extended or adjusted under 35 U.S.C. 154(b) by 116 days.

(21) Appl. No.: 19/004,536

(22) Filed: Dec. 30, 2024

(65) Prior Publication Data

US 2025/0248522 A1 Aug. 7, 2025

(51) Int. Cl.
*A47C 1/034* (2006.01)

(52) U.S. Cl.
CPC ..... *A47C 1/0345* (2013.01)

(58) Field of Classification Search
CPC ..... A47C 1/0345; A47C 1/0355; A47C 1/035
See application file for complete search history.

(56) References Cited

U.S. PATENT DOCUMENTS

| | | | | |
|---|---|---|---|---|
| 8,398,168 | B2 * | 3/2013 | Lawson | A47C 1/0355 297/259.2 |
| 10,842,273 | B2 * | 11/2020 | Fei | A47C 1/0355 |
| 11,638,483 | B2 * | 5/2023 | Sun | A47C 1/03211 297/75 |
| 12,082,698 | B2 * | 9/2024 | Liu | A47C 1/0242 |
| 12,178,325 | B2 * | 12/2024 | Li | A47C 1/0355 |
| 12,310,509 | B2 * | 5/2025 | Liu | A47C 1/024 |
| 12,453,422 | B2 * | 10/2025 | Lake | A47C 1/03211 |
| 2017/0311729 | A1 * | 11/2017 | Xu | A47C 20/10 |
| 2025/0160521 | A1 * | 5/2025 | Cai | A47C 1/0345 |

* cited by examiner

*Primary Examiner* — David R Dunn

(57) ABSTRACT

A mechanical extending mechanism includes a first connecting member, a second connecting member, a third connecting member, a fourth connecting member, a fifth connecting member and a sixth connecting member. The first connecting member is provided with a first rotating portion, the third connecting member is provided with a second rotating portion, and the first rotating portion is rotatably connected to the second rotating portion.

18 Claims, 11 Drawing Sheets

MECHANICAL EXTENDING MECHANISM AND CHAIR

CROSS-REFERENCE TO RELATED APPLICATION

This application claims priority to Chinese patent application No. 202420289561.7, filed on Feb. 7, 2024, the content of which is hereby incorporated by reference in its entirety.

TECHNICAL FIELD

The present disclosure relates to the field of connecting rod, in particular, to a mechanical extending mechanism and chair.

BACKGROUND

The polymorphic chair has a number of different unfolding states, each of which supports the human body in a particular way. Common deployment states of a polymorphic chair include a seating state, a lifting state, a TV state, a leisure state, and the like.

A polymorphic chair includes a linear actuator and a great number of connecting rods. The linear actuator is capable of controlling rotation of the connecting rods with respect to each other, so that the polymorphic chair can be switched between the different states of deployment. Currently, since the connecting rod mechanism is complex, the polymorphic chairs generally require a plurality of linear actuators to work together to satisfy the need for the polymorphic chair to switch between different unfolded states, which results in the polymorphic chair having a high cost.

SUMMARY

A mechanical extending mechanism includes a first connecting, a second connecting member, a third connecting member, a fourth connecting member, a fifth connecting member and a sixth connecting member. The first connecting member is provided with a first rotating portion, the third connecting member is provided with a second rotating portion, and the first rotating portion is rotatably connected to the second rotating portion; the third connecting member is provided with a third rotating portion, the fourth connecting member is provided with a fifth rotating portion, and the third rotating portion is rotatably connected to the fifth rotating portion; the fourth connecting member is provided with a sixth rotating portion, the sixth connecting member is provided with a seventh rotating portion, and the sixth rotating portion is rotatably connected to the seventh rotating portion; the sixth connecting member is provided with an eighth rotating portion, the first connecting member is provided with a ninth rotating portion, and the eighth rotating portion is rotatably connected to the ninth rotating portion; the fifth connecting member is provided with a tenth connecting portion, the third connecting member is provided with an eleventh connecting portion, and the tenth connecting portion is rotatably connected to the eleventh connecting portion; the fifth connecting member is provided with a twelfth connecting portion, the second connecting member is provided with a thirteenth connecting portion, and the twelfth connecting portion is rotatably connected to the thirteenth connecting portion; and the second connecting member is provided with a fourteenth connecting portion, the sixth connecting member is provided with a fifteenth connecting portion, and the fourteenth connecting portion is rotatably connected to the fifteenth connecting portion.

In some embodiments, the mechanical extending mechanism further includes a supporting assembly. The supporting assembly includes a first supporting member, a bearing member and a second supporting member; the second connecting member is provided with a sixteenth rotating portion, the first supporting member is provided with a seventeenth rotating portion, and the sixteenth rotating portion is rotatably connected to the seventeenth rotating portion; the first supporting member is provided with an eighteenth rotating portion, the bearing member is provided with a nineteenth rotating portion, and the eighteenth rotating portion is rotatably connected to the nineteenth rotating portion; the bearing member is provided with a twentieth rotating portion, the second supporting member is provided with a twenty-first rotating portion, and the twentieth rotating portion is rotatably connected to the twenty-first rotating portion; and the second supporting member is provided with a twenty-second rotating portion, the first connecting member is provided with a twenty-third rotating portion, and the twenty-second rotating portion is rotatably connected to the twenty-third rotating portion.

In some embodiments, the mechanical extending mechanism further includes a backrest assembly. The backrest assembly includes a first backrest connecting member and a second backrest connecting member; the sixth connecting member is provided with a twenty-fourth rotating portion, the first backrest connecting member is provided with a twenty-fifth rotating portion, and the twenty-fourth rotating portion is rotatably connected to the twenty-fifth rotating portion; the first backrest connecting member is provided with a twenty-sixth rotating portion, the second backrest connecting member is provided with a twenty-seventh rotating portion, the twenty-sixth rotating portion is rotatably connected to the twenty-seventh rotating portion, one of the first backrest connecting member and the second backrest connecting member is provided with a restricting groove, and the other of the first backrest connecting member and the second backrest connecting member is restricted by the restricting groove to achieve a limited rotating angle; and the second backrest connecting member is provided with a twenty-eighth rotating portion, the bearing member is provided with a twenty-ninth rotating portion, and the twenty-eighth rotating portion is rotatably connected to the twenty-ninth rotating portion.

In some embodiments, the mechanical extending mechanism further includes a footrest assembly. The footrest assembly includes a first leg connecting member, a second leg connecting member, a third leg connecting member, a fourth leg connecting member, a fifth leg connecting member and a footrest member; the first leg connecting member is provided with a thirtieth rotating portion, the bearing member is provided with a thirty-first rotating portion, and the thirtieth rotating portion is rotatably connected to the thirty-first rotating portion; the second leg connecting member is provided with a thirty-second rotating portion, the first leg connecting member is provided with a thirty-third rotating portion, and the thirty-second rotating portion is rotatably connected to the thirty-third rotating portion; the second leg connecting member is provided with a thirty-fourth rotating portion, the footrest member is provided with a thirty-fifth rotating portion, and the thirty-fourth rotating portion is rotatably connected to the thirty-fifth rotating portion; the third leg connecting member is provided with a thirty-sixth rotating portion, the footrest member is provided with a thirty-seventh rotating portion, and the thirty-sixth rotating portion is rotatably connected to the thirty-seventh rotating portion; the third leg connecting member is provided with a thirty-eighth rotating portion, the fourth leg connecting member is provided with a thirty-ninth rotating portion, and the thirty-eighth rotating portion is rotatably connected to the thirty-ninth rotating portion; the fourth leg connecting member is provided with a fortieth rotating portion, the second supporting member is provided with a forty-first rotating portion, and the fortieth rotating portion is rotatably connected to the forty-first rotating portion; the first leg connecting member is provided with a forty-second rotating portion, the fifth leg connecting member is provided with a forty-third rotating portion, and the forty-second rotating portion is rotatably connected to the forty-third rotating portion; the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

In some embodiments, the mechanical extending mechanism further includes a driving assembly. The driving assembly includes a pedestal, a linear actuator, a first transmission member and a second transmission member. The first transmission member is provided with a forty-sixth rotating portion, and both ends of the linear actuator are rotatably connected to the pedestal and the forty-sixth rotating portion, respectively; the second transmission member is provided with a forty-seventh rotating portion, the first transmission member is provided with a forty-eighth rotating portion, and the forty-seventh rotating portion is rotatably connected to the forty-eighth rotating portion; and the bearing member is provided with a forty-ninth rotating portion, the second transmission member is provided with a fiftieth rotating portion, and the forty-ninth rotating portion is rotatably connected to the fiftieth rotating portion.

In some embodiments, the driving assembly further includes a third transmission member fixed to the sixth connecting member; and the first transmission member is provided with a fifty-first rotating portion, the third transmission member is provided with a fifty-second rotating portion, and the fifty-first rotating portion is rotatably connected to the fifty-second rotating portion.

In some embodiments, a supporting plate is fixed to the pedestal, the supporting plate is provided with a fifty-third rotating portion and a fifty-fourth rotating portion, and the third transmission member is provided with a fifty-fifth rotating portion and a fifty-sixth rotating portion; and the driving assembly further includes a first connecting rod and a second connecting rod, both ends of the first connecting rod are rotatably connected to the fifty-third rotating portion and the fifty-fifth rotating portion, respectively, and both ends of the second connecting rod are rotatably connected to the fifty-fourth rotating portion and the fifty-sixth rotating portion, respectively.

In some embodiments, the mechanical extending mechanism further includes a footrest assembly. The footrest assembly includes a first leg connecting member, a second leg connecting member, a third leg connecting member, a fourth leg connecting member, a fifth leg connecting member and a footrest member. The first leg connecting member is provided with a thirtieth rotating portion, the bearing member is provided with a thirty-first rotating portion, and the thirtieth rotating portion is rotatably connected to the thirty-first rotating portion; the second leg connecting member is provided with a thirty-second rotating portion, the first leg connecting member is provided with a thirty-third rotating portion, and the thirty-second rotating portion is rotatably connected to the thirty-third rotating portion; the second leg connecting member is provided with a thirty-fourth rotating portion, the footrest member is provided with a thirty-fifth rotating portion, and the thirty-fourth rotating portion is rotatably connected to the thirty-fifth rotating portion; the third leg connecting member is provided with a thirty-sixth rotating portion, the footrest member is provided with a thirty-seventh rotating portion, and the thirty-sixth rotating portion is rotatably connected to the thirty-seventh rotating portion; the third leg connecting member is provided with a thirty-eighth rotating portion, the fourth leg connecting member is provided with a thirty-ninth rotating portion, and the thirty-eighth rotating portion is rotatably connected to the thirty-ninth rotating portion; the fourth leg connecting member is provided with a fortieth rotating portion, the bearing member is provided with a fifty-seventh rotating portion, and the fortieth rotating portion is rotatably connected to the fifty-seventh rotating portion; the first leg connecting member is provided with a forty-second rotating portion, the fifth leg connecting member is provided with a forty-third rotating portion, and the forty-second rotating portion is rotatably connected to the forty-third rotating portion; the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

In some embodiments, the sixth connecting member is provided with a first restricting piece and a second restricting piece, at least a part of the second connecting member is located between the first restricting piece and the second restricting piece, and the first restricting piece and the second restricting piece are configured for restricting the second connecting member.

A chair includes the mechanical extending mechanism.

Details of one or more embodiments of the present application are presented in the following accompanying drawings and description in order to make other features, purposes and advantages of the present application more concise and understandable.

BRIEF DESCRIPTION OF THE DRAWINGS

In order to illustrate the embodiments of the present disclosure more clearly, the drawings used in the embodiments will be described briefly. Apparently, the following described drawings are merely for the embodiments of the present disclosure, and other drawings can be derived by those of ordinary skill in the art without any creative effort.

Figure 1:
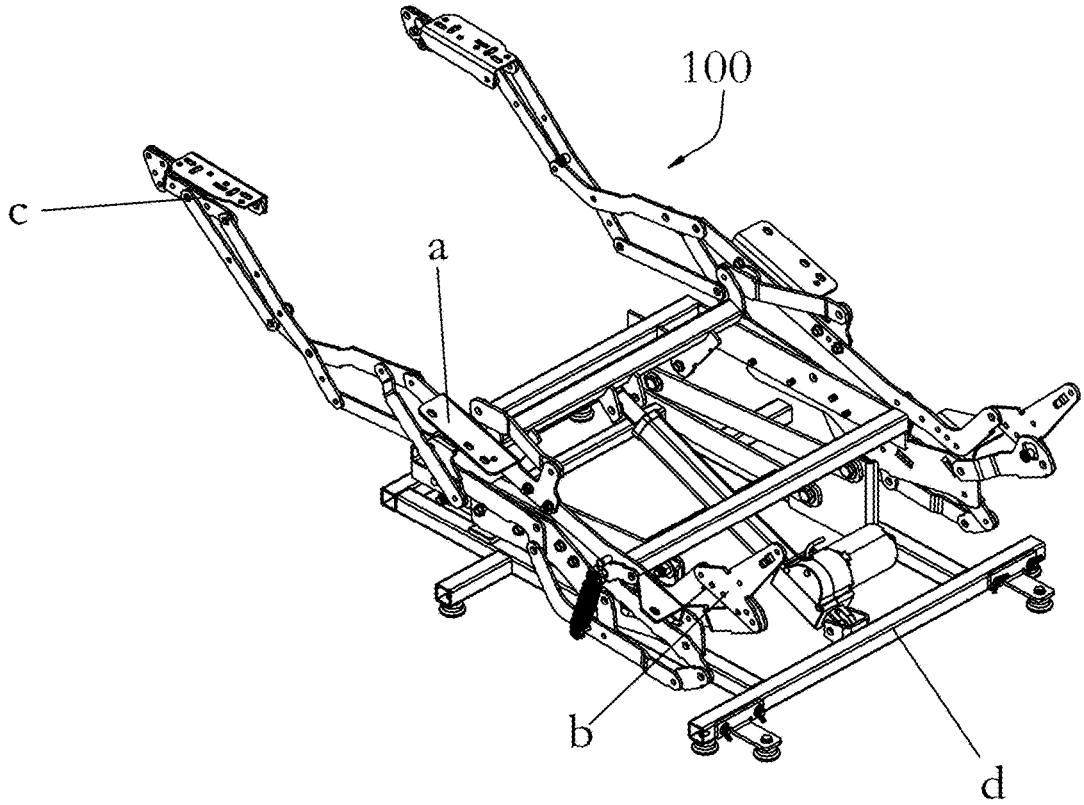
FIG. 1 is a first stereo schematic diagram of a chair (in a TV state) in a first embodiment of the present disclosure.

In the figures,

100 represents a mechanical extending mechanism; 1 represents a first connecting member; 11 represents a first rotating portion; 12 represents a ninth rotating portion; 13 represents a twenty-third rotating portion; 2 represents a second connecting member; 21 represents a thirteenth connecting portion; 22 represents a fourteenth connecting portion; 23 represents a sixteenth rotating portion; 3 represents a third connecting member; 31 represents a second rotating portion; 32 represents a third rotating portion; 33 represents an eleventh connecting portion; 4 represents a fourth connecting member; 41 represents a fifth rotating portion; 42 represents a sixth rotating portion; 5 represents a fifth connecting member; 51 represents a tenth connecting portion; 52 represents a twelfth connecting portion; 6 represents a sixth connecting member; 61 represents a seventh rotating portion; 62 represents an eighth rotating portion; 63 represents a fifteenth connecting portion; 64 represents a first restricting piece; 65 represents a second restricting piece; 66 represents a twenty-fourth rotating portion; a represents a supporting assembly; a1 represents a first supporting member; a11 represents a seventeenth rotating portion; a12 represents an eighteenth rotating portion; a2 represents a bearing member; a21 represents a nineteenth rotating portion; a22 represents a twentieth rotating portion; a23 represents a twenty-ninth rotating portion; a24 represents a thirty-first rotating portion; a25 represents an metal member; a26 represents a fifty-seventh rotating portion; a27 represents a forty-ninth rotating portion; a3 represents a second supporting member; a31 represents a twenty-first rotating portion; a32 represents a twenty-second rotating portion; a33 represents a forty-first rotating portion; a34 represents a forty-fifth rotating portion; b represents a backrest assembly; b1 represents a first backrest connecting member; b11 represents a twenty-fifth rotating portion; b12 represents a twenty-sixth rotating portion; b13 represents a restricting groove; b2 represents a second backrest connecting member; b21 represents a twenty-seventh rotating portion; b22 represents a twenty-eighth rotating portion; c represents a footrest assembly; c1 represents a first leg connecting member; c11 represents a thirtieth rotating portion; c12 represents a thirty-third rotating portion; c13 represents a forty-second rotating portion; c14 represents a fifty-eighth rotating portion; c2 represents a second leg connecting member; c21 represents a thirty-second rotating portion; c22 represents a thirty-fourth rotating portion; c3 represents a third leg connecting member; c31 represents a thirty-sixth rotating portion; c32 represents a thirty-eighth rotating portion; c33 represents a fifty-ninth rotating portion; c4 represents a fourth leg connecting member; c41 represents a thirty-ninth rotating portion; c42 represents a fortieth rotating portion; c5 represents a fifth leg connecting member; c51 represents a forty-third rotating portion; c6 represents a footrest member; c61 represents a thirty-fifth rotating portion; c62 represents a thirty-seventh rotating portion; d represents a driving assembly; d1 represents a pedestal; d11 represents a supporting plate; d111 represents a fifty-third rotating portion; d112 represents a fifty-fourth rotating portion; d2 represents a linear actuator; d3 represents a first transmission member; d31 represents a forty-sixth rotating portion; d32 represents a forty-eighth rotating portion; d33 represents a fifty-first rotating portion; d4 represents a second transmission member; d41 represents a forty-seventh rotating portion; d42 represents a fiftieth rotating portion; d5 represents a third transmission member; d51 represents a fifty-second rotating portion; d52 represents a fifty-fifth rotating portion; d53 represents a fifty-sixth rotating portion; d6 represents a first connecting rod; and d7 represents a second connecting rod.

DETAILED DESCRIPTION

In order that the foregoing purposes, features and advantages of the present disclosure may be made more apparent and understandable, specific embodiments of the present disclosure are described in detail below in conjunction with the accompanying drawings. Many specific details are set forth in the following description to facilitate a full understanding of the present disclosure. However, the present disclosure is capable of being implemented in many other ways different from those described herein, and those skilled in the art may make similar improvements without violating the connotations of the present disclosure, and thus the present disclosure is not limited by the specific embodiments disclosed below.

In the present disclosure, it is to be understood that the terms "centre", "longitudinal", "length", "width", "thickness", "on", "under", "front", "back", "left", "right", "vertical", "horizontal", "top", "bottom", "left", "right", "vertical", "horizontal", "top", "bottom", "inside", "outside", "clockwise", "counterclockwise", "axial", "radial", "circumferential", and the like indicate an orientation or positional relationship based on that shown in the accompanying drawings. The terms are only for the purpose of facilitating the description of the present disclosure and simplifying the description, and is not intended to indicate or imply that the device or element referred to has to have a particular orientation, and be constructed and operated with a particular orientation, and is therefore not to be understood as a limitation of the present disclosure.

Furthermore, the terms "first", "second" are used for descriptive purposes only and are not to be understood as indicating or implying relative importance or implicitly specifying the number of technical features indicated. Thus, a feature defined with the terms "first", "second" may include at least one such feature, either explicitly or implicitly. In the description of the present disclosure, "plurality" means at least two, e.g., two, three, etc., unless otherwise expressly and specifically limited.

In the present disclosure, the terms "mounting", "connecting", "abutting", "fixing" and the like are to be understood in a broad sense, unless otherwise expressly specified and limited. For example, it may be a fixed connection, a removable connection, or an integer structure; it may be a mechanical connection or an electrical connection; it may be a direct connection or an indirect connection through an intermediate medium, and it may be a connection within the two elements or an interaction between the two elements, unless otherwise expressly limited. For a person of ordinary skill in the art, the specific meaning of the above terms in the present disclosure may be understood according to the specific circumstances.

In the present disclosure, unless otherwise expressly specified and limited, the first feature "on" or "under" the second feature may be that the first feature is in direct contact with the second feature, or that the first feature is in indirect contact with the second feature through an intermediate medium. Furthermore, the first feature being "above", "on" or "upon" the second feature may mean that the first feature is directly above or diagonally above the second feature, or it may simply mean that the first feature is horizontally higher than the second feature. The first feature being "below", "under" or "beneath" the second feature may be that the first feature is directly below or diagonally below the second feature, or it may simply mean that the first feature is horizontally smaller than the second feature.

It is noted that when a component is said to be "fixed to" or "disposed on" another component, it may be directly on the other component or there may be a centred component. When a component is said to be "connected" to another component, it may be directly connected to the other component or there may be both centred components. The terms "vertical", "horizontal", "up", "down", "left", "right" and similar expressions used in the specification of the present disclosure are for illustrative purposes only and are not meant to be exclusive.

First Embodiment

Referring to FIG. 1 to FIG. 4, a chair is provided in the present embodiment. The chair includes a mechanical extending mechanism 100. The mechanical extending mechanism 100 includes a supporting assembly a, a backrest assembly b, a footrest assembly c, a driving assembly d, a first connecting member 1, a second connecting member 2, a third connecting member 3, a fourth connecting member 4, a fifth connecting member 5 and a sixth connecting member 6.

The transmission assembly is defined by the first connecting member 1, the second connecting member 2, the third connecting member 3, the fourth connecting member 4, the fifth connecting member 5 and sixth connecting member 6. All of the supporting assembly a, the backrest assembly b and the footrest assembly c are disposed on the transmission assembly. The driving assembly d can adjust relative positions between the supporting assembly a, the backrest assembly b the footrest assembly c via the transmission assembly, so as to change an unfolded state of the mechanical extending mechanism. In the present embodiment, the mechanical extending mechanism has at least four unfolded states including a seating state, a lifting state, a TV state and a leisure state. Application scenarios of the four unfolded states are existing in the related art, which will not be repeated hereinafter in the present embodiment.

The first connecting member 1 is provided with a first rotating portion 11, a ninth rotating portion 12 and a twenty-third rotating portion 13. The first connecting member 1 is approximately an L-shaped plate. The first rotating portion 11 and the twenty-third rotating portion 13 are located at two ends of the first connecting member 1. The ninth rotating portion 12 is located at a bended position of the first connecting member 1. A distance between the twenty-third rotating portion 13 and the ninth rotating portion 12 is greater than a distance between the first rotating portion 11 and the ninth rotating portion 12.

The second connecting member 2 is provided with a thirteenth connecting portion 21, a fourteenth connecting portion 22 and a sixteenth rotating portion 23. The second connecting member 2 is approximately strip-shaped. The thirteenth connecting portion 21 and the sixteenth rotating portion 23 are located at two ends of the second connecting member 2, respectively. The fourteenth connecting portion 22 is located between the thirteenth connecting portion 21 and the sixteenth rotating portion 23. A distance between the fourteenth connecting portion 22 and the thirteenth connecting portion 21 is less than a distance between the fourteenth connecting portion 22 and the sixteenth rotating portion 23.

The third connecting member 3 is provided with a second rotating portion 31, a third rotating portion 32 and an eleventh connecting portion 33. The third connecting member 3 is approximately an L-shaped plate. The second rotating portion 31 and the eleventh connecting portion 33 are located at two ends of the third connecting member 3, respectively. The third rotating portion 32 is located between the second rotating portion 31 and the eleventh connecting portion 33.

The fourth connecting member 4 is provided with a fifth rotating portion 41 and a sixth rotating portion 42. The fourth connecting member 4 is approximately strip-shaped. The fifth rotating portion 41 and the sixth rotating portion 42 are located at two ends of the fourth connecting member 4, respectively.

The fifth connecting member 5 is provided with a tenth connecting portion 51 and a twelfth connecting portion 52. A shape of the fifth connecting member 5 is approximately similar to a shape of the fourth connecting member 4. The tenth connecting portion 51 and the twelfth connecting portion 52 are located at two ends of the fifth connecting member 5, respectively.

The sixth connecting member 6 is a plane plate, and an outline of the sixth connecting member 6 is approximately wave-shape. The sixth connecting member 6 is provided with a seventh rotating portion 61, an eighth rotating portion 62, a fifteenth connecting portion 63 and a twenty-fourth rotating portion 66. The fifteenth connecting portion 63 and the twenty-fourth rotating portion 66 are located at the same end of the sixth connecting member 6, and the fifteenth connecting portion 63 is spaced from the twenty-fourth rotating portion 66. The eighth rotating portion 62 is located at a position relatively adjacent to the other end of the sixth connecting member 6, and the seventh rotating portion 61 is located between the eighth rotating portion 62 and the fifteenth connecting portion 63.

The first rotating portion 11 is rotatably connected to the second rotating portion 31, the third rotating portion 32 is rotatably connected to the fifth rotating portion 41, the sixth rotating portion 42 is rotatably connected to the seventh rotating portion 61, and the eighth rotating portion 62 is rotatably connected to the ninth rotating portion 12. Therefore, a rectangle-shaped connecting rod mechanism is defined by the first connecting member 1, the third connecting member 3, the fourth connecting member 4 and the sixth connecting member 6.

On the basis that the sixth rotating portion 42 is rotatably connected to the seventh rotating portion 61, and the third rotating portion 32 is rotatably connected to the fifth rotating portion 41, the tenth connecting portion 51 is rotatably connected to the eleventh connecting portion 33, the twelfth connecting portion 52 is rotatably connected to the thirteenth connecting portion 21, and the fourteenth connecting portion 22 is rotatably connected to the fifteenth connecting portion 63. Therefore, a pentagon-shaped connecting rod mechanism is defined by the second connecting member 2, the third connecting member 3, the fourth connecting member 4, the fifth connecting member 5 and the sixth connecting member 6.

It should be noted that in the connection described above, a pentagon-shaped is also defined by the first connecting member 1, the second connecting member 2, the third connecting member 3, the fifth connecting member 5 and the sixth connecting member 6.

The sixth connecting member 6 is provided with a first restricting piece 64 and a second restricting piece 65. A part of the second connecting member 2 is located between the first restricting piece 64 and the second restricting piece 65. The first restricting piece 64 and the second restricting piece 65 are located between the seventh rotating portion 61 and the twenty-fourth rotating portion 66. The second restricting piece is more adjacent to the twenty-fourth rotating portion 66, and the first restricting piece 64 is more adjacent to the seventh rotating portion 61.

Figure 2:
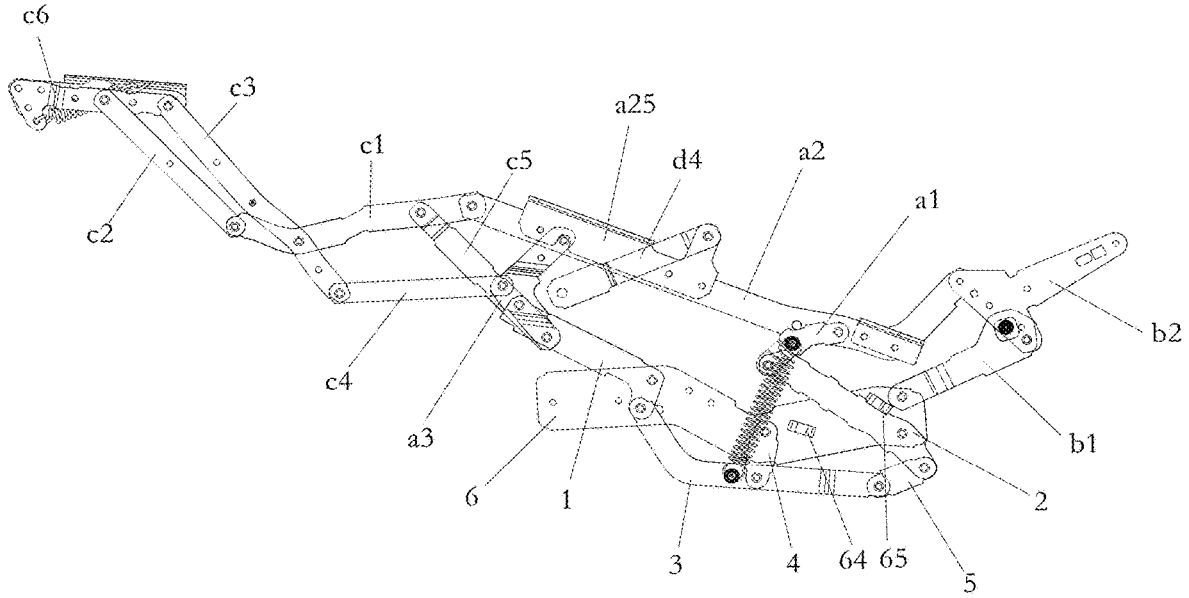
FIG. 2 is a front view of a chair in a TV state in a first embodiment of the present disclosure, in which a driving assembly is omitted.
Figure 3:
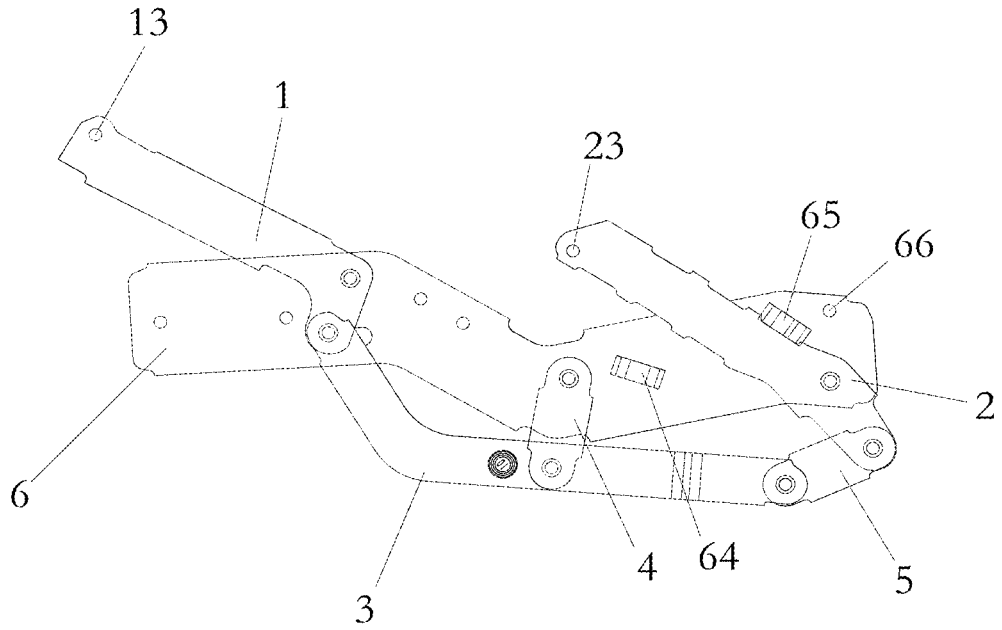
FIG. 3 is a front view of a transmission assembly of a chair in a first embodiment of the present disclosure.
Figure 4:
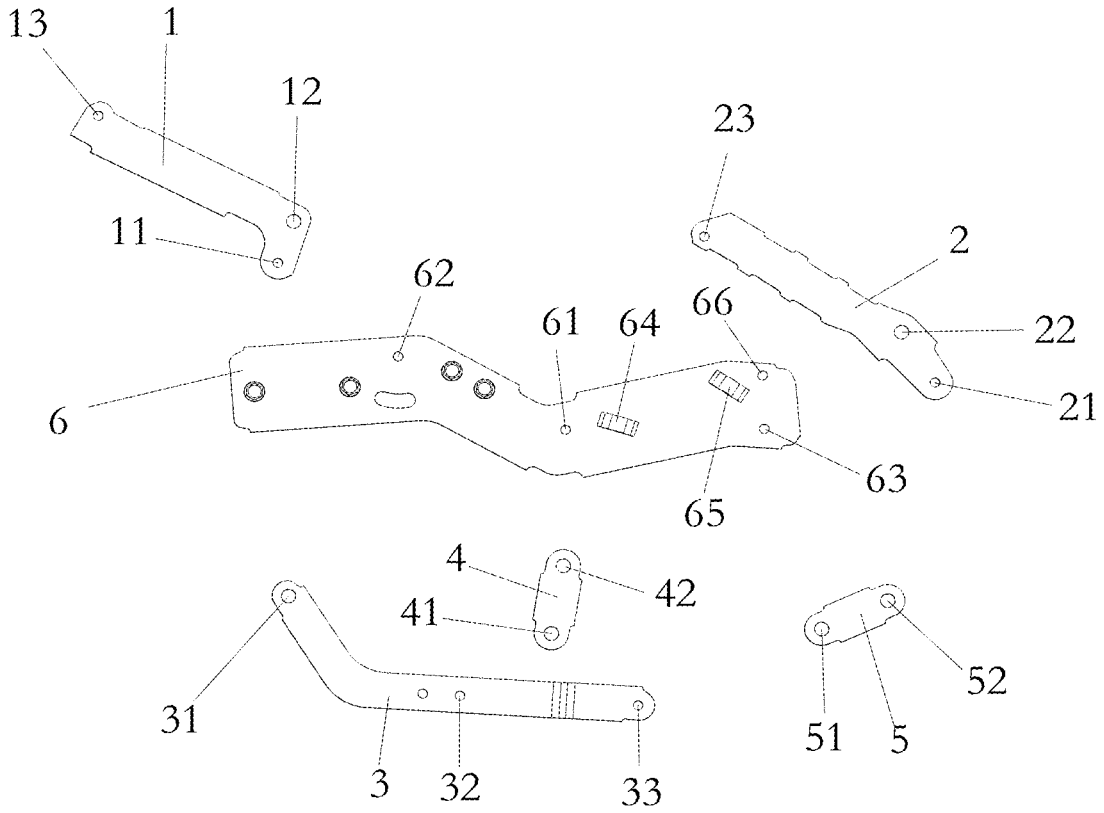
FIG. 4 is an explosive view of a transmission assembly of a chair in a first embodiment of the present disclosure.
Figure 5:
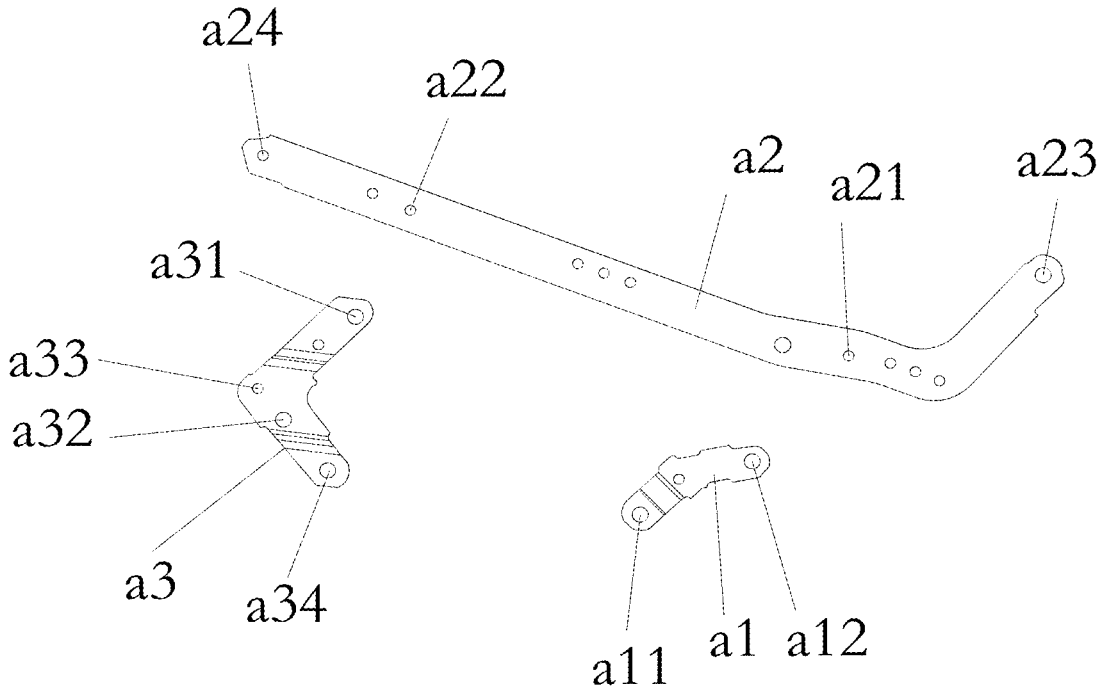
FIG. 5 is an explosive view of a supporting assembly of a chair in a first embodiment of the present disclosure.

Referring to FIG. 2 and FIG. 5, the supporting assembly a includes a first supporting member a1, a bearing member a2 and a second supporting member a3.

The first supporting member a1 is provided with a seventeenth rotating portion a11 and an eighteenth rotating portion a12. The first supporting member a1 is a plane plate, and an outline of the first supporting member a1 is strip-shaped. The seventeenth rotating portion a11 and the eighteenth rotating portion a12 are disposed at two ends of the first supporting member a1, respectively.

The bearing member a2 is provided with a nineteenth rotating portion a21, a twentieth rotating portion a22, a twenty-ninth rotating portion a23 and a thirty-first rotating portion a24. The bearing member a2 is an L-shaped plate. The twenty-ninth rotating portion a23 and the thirty-first rotating portion a24 are located at two ends of the bearing member a2, respectively. The nineteenth rotating portion a21 and the twentieth rotating portion a22 are located between the twenty-ninth rotating portion a23 and the thirty-first rotating portion a24. The twentieth rotating portion a22 is located between the thirty-first rotating portion a24 and the nineteenth rotating portion a21. A distance between the twentieth rotating portion a22 and the thirty-first rotating portion a24 is approximately equal to a distance between the nineteenth rotating portion a21 and the twenty-ninth rotating portion a23, and both the distance between the twentieth rotating portion a22 and the thirty-first rotating portion a24 and the distance between the nineteenth rotating portion a21 and the twenty-ninth rotating portion a23 are much less than a distance between the nineteenth rotating portion a21 and the twentieth rotating portion a22.

The second supporting member a3 is approximately L-shaped, and the second supporting member a3 is provided with a twenty-first rotating portion a31, a twenty-second rotating portion a32, a forty-first rotating portion a33 and a forty-fifth rotating portion a34. The twenty-first rotating portion a31 and the forty-fifth rotating portion a34 are located at two ends of the second supporting member a3, respectively. The forty-first rotating portion a33 is located at a bended position of the second supporting member a3. The twenty-second rotating portion a32 is located between the forty-first rotating portion a33 and the forty-fifth rotating portion a34. A distance between the twenty-first rotating portion a31 and the forty-first rotating portion a33 is approximately equal to a distance between the forty-fifth rotating portion a34 and the forty-first rotating portion a33.

The twentieth rotating portion a22 is rotatably connected to the twenty-first rotating portion a31, the twenty-second rotating portion a32 is rotatably connected to the twenty-third rotating portion 13, the eighteenth rotating portion a12 is rotatably connected to the nineteenth rotating portion a21, and the sixteenth rotating portion 23 is rotatably connected to the seventeenth rotating portion a11. Therefore, the first supporting member a1, the bearing member a2 and the second supporting member a3 are controlled by a transmission assembly defined by the first connecting member 1, the second connecting member 2, the third connecting member 3, the fourth connecting member 4, the fifth connecting member 5 and the sixth connecting member 6.

Figure 6:
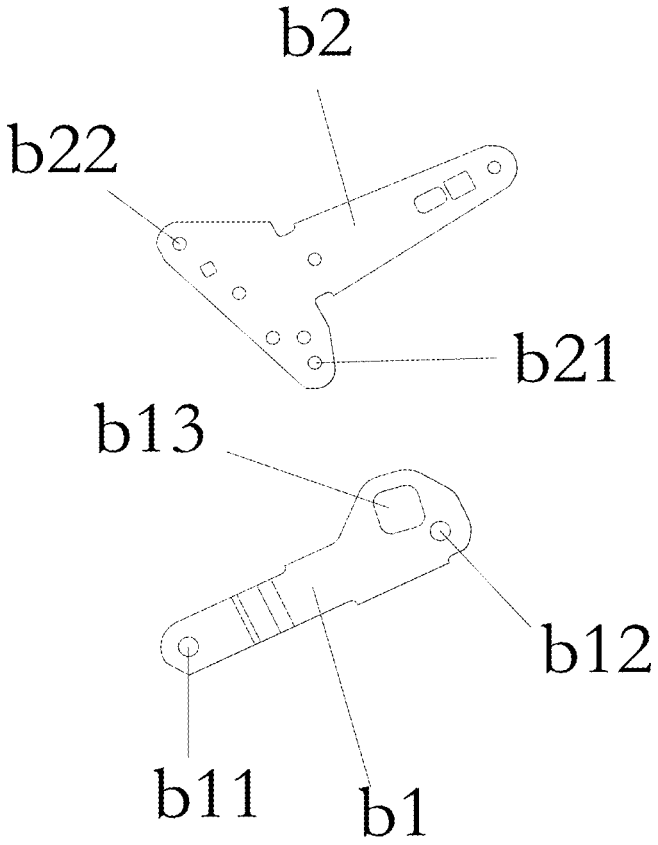
FIG. 6 is an explosive view of a backrest assembly of a chair in a first embodiment of the present disclosure.

Referring to FIG. 2 and FIG. 6, the backrest assembly b includes a first backrest connecting member b1 and a second backrest connecting member b2.

The first backrest connecting member b1 is provided with a twenty-fifth rotating portion b11 and a twenty-sixth rotating portion b12. The first backrest connecting member b1 is approximately strip-shaped. The twenty-fifth rotating portion b11 and the twenty-sixth rotating portion b12 are disposed at two ends of the first backrest connecting member b1, respectively.

An outline of the second backrest connecting member b2 is approximately triangle-shaped. The second backrest connecting member b2 is provided with a twenty-seventh rotating portion b21 and a twenty-eighth rotating portion b22. The twenty-seventh rotating portion b21 and the twenty-eighth rotating portion b22 are located at two vertexes of the second backrest connecting member b2.

The twenty-fourth rotating portion 66 is rotatably connected to the twenty-fifth rotating portion b11, the twenty-sixth rotating portion b12 is rotatably connected to the twenty-seventh rotating portion b21, and the twenty-eighth rotating portion b22 is rotatably connected to the twenty-ninth rotating portion a23. The first backrest connecting member b1 is provided with a restricting groove b13, the second backrest connecting member b2 is provided with a restricting column. The restricting column can be snapped in the restricting groove b13, so that a rotating angle between the first backrest connecting member b1 and the second backrest connecting member is limited. In some embodiments, a location of the restricting groove b13 and a location of the restricting column can be replaced.

On the basis of the structure above, the backrest assembly b is not only directly connected to the supporting assembly a, but also is in connection with the transmission assembly. The transmission assembly not only can adjust a location state of the backrest assembly b, but also can allow the location state of the backrest assembly b to match with the supporting assembly a, so as to smoothly switch the chair between different unfolded states.

Figure 7:
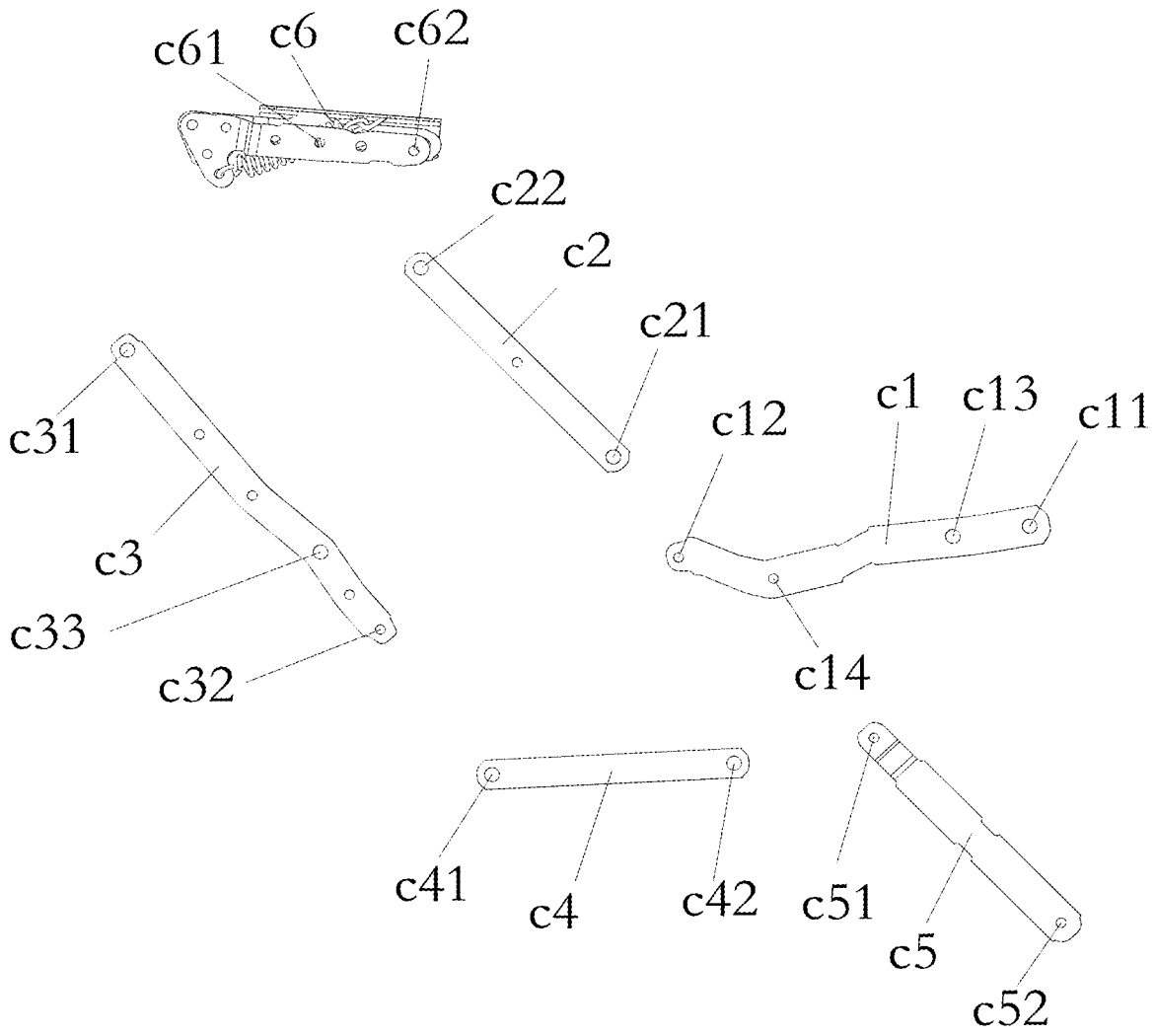
FIG. 7 is an explosive view of a footrest assembly of a chair in a first embodiment of the present disclosure.

Referring to FIG. 2 and FIG. 7, footrest assembly c includes a first leg connecting member c1, a second leg connecting member c2, a third leg connecting member c3, a fourth leg connecting member c4, a fifth leg connecting member c5 and a footrest member c6. All of the first leg connecting member c1, the second leg connecting member c2, the third leg connecting member c3, the fourth leg connecting member c4, the fifth leg connecting member c5 and the footrest member c6 are approximately strip-shaped.

The first leg connecting member c1 is provided with a thirtieth rotating portion c11, a forty-second rotating portion c13, a fifty-eighth rotating portion c14 and a thirty-third rotating portion c12. The thirtieth rotating portion c11 and the thirty-third rotating portion c12 are located at two ends of the first leg connecting member c1, respectively. The forty-second rotating portion c13 is located between the thirtieth rotating portion c11 and the thirty-third rotating portion c12, and the forty-second rotating portion c13 is more adjacent to the thirtieth rotating portion c11.

The second leg connecting member c2 is provided with a thirty-second rotating portion c21 and a thirty-fourth rotating portion c22. The thirty-second rotating portion c21 and the thirty-fourth rotating portion c22 are located at both ends of the second leg connecting member c2, respectively.

The third leg connecting member c3 is provided with a fifty-ninth rotating portion c33, a thirty-sixth rotating portion c31 and a thirty-eighth rotating portion c32. The thirty-sixth rotating portion c31 and the thirty-eighth rotating portion c32 are located at two ends of the third leg connecting member c3, respectively.

The fourth leg connecting member c4 is provided with a thirty-ninth rotating portion c41 and a fortieth rotating portion c42. The thirty-ninth rotating portion c41 and the fortieth rotating portion c42 are located at two ends of the fourth leg connecting member c4, respectively.

The fifth leg connecting member c5 is provided with a forty-third rotating portion c51 and a forty-fourth rotating portion c52. The forty-third rotating portion c51 and the forty-fourth rotating portion c52 are located at two ends of the fifth leg connecting member c5, respectively.

The footrest member c6 is provided with a thirty-fifth rotating portion c61 and a thirty-seventh rotating portion c62. The thirty-fifth rotating portion c61 is located in the middle of the footrest member c6. The thirty-seventh rotating portion c62 is located at one end of the footrest member c6.

In the present embodiment, the thirtieth rotating portion c11 is rotatably connected to the thirty-first rotating portion a24, the thirty-second rotating portion c21 is rotatably connected to the thirty-third rotating portion c12, the thirty-fourth rotating portion c22 is rotatably connected to the thirty-fifth rotating portion c61, the thirty-sixth rotating portion c31 is rotatably connected to the thirty-seventh rotating portion c62, the thirty-eighth rotating portion c32 is rotatably connected to the thirty-ninth rotating portion c41, the fortieth rotating portion c42 is rotatably connected to the forty-first rotating portion a33, the forty-second rotating portion c13 is rotatably connected to the forty-third rotating portion c51, the forty-fourth rotating portion c52 is rotatably connected to the forty-fifth rotating portion a34, and the fifty-eighth rotating portion c14 is rotatably connected to the fifty-ninth rotating portion c33. The footrest assembly c is connected to the transmission assembly via the supporting assembly a, not only the location state of the footrest assembly is controlled by the transmission assembly, but also the location state of the footrest assembly c can be matched with the supporting assembly a, so as to smoothly switch the chair between different unfolded states.

Figure 8:
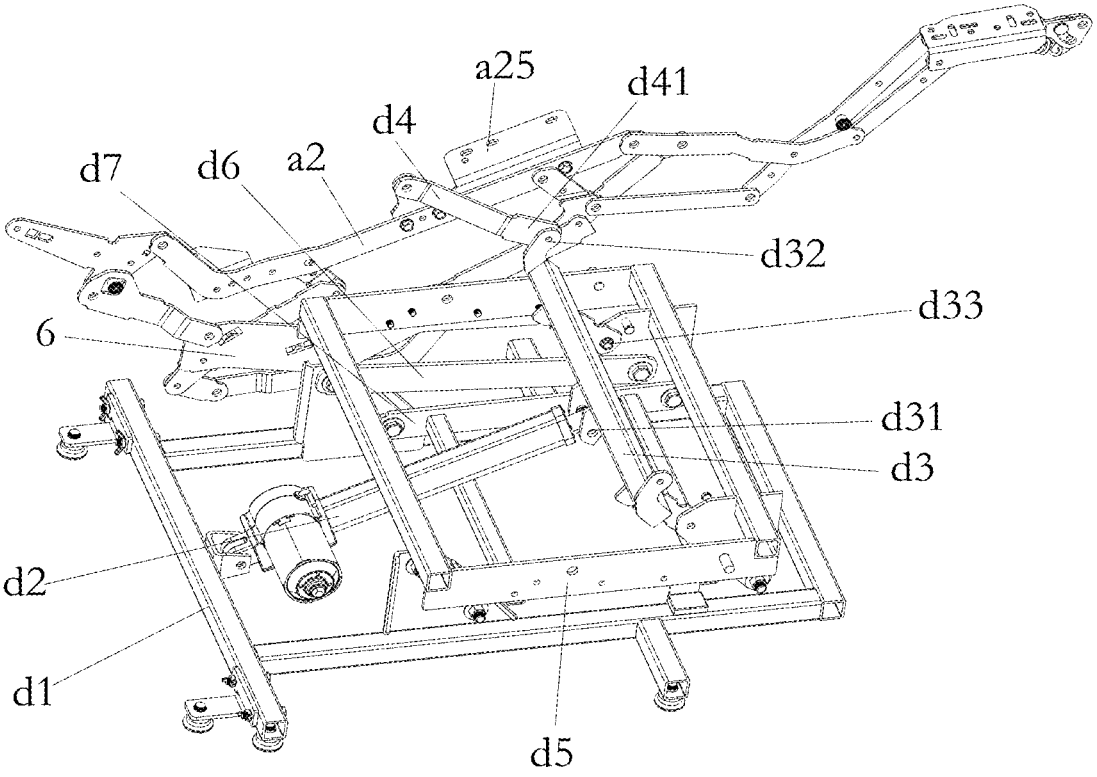
FIG. 8 a second stereo schematic diagram of a chair (in a TV state) in a first embodiment of the present disclosure.
Figure 9:
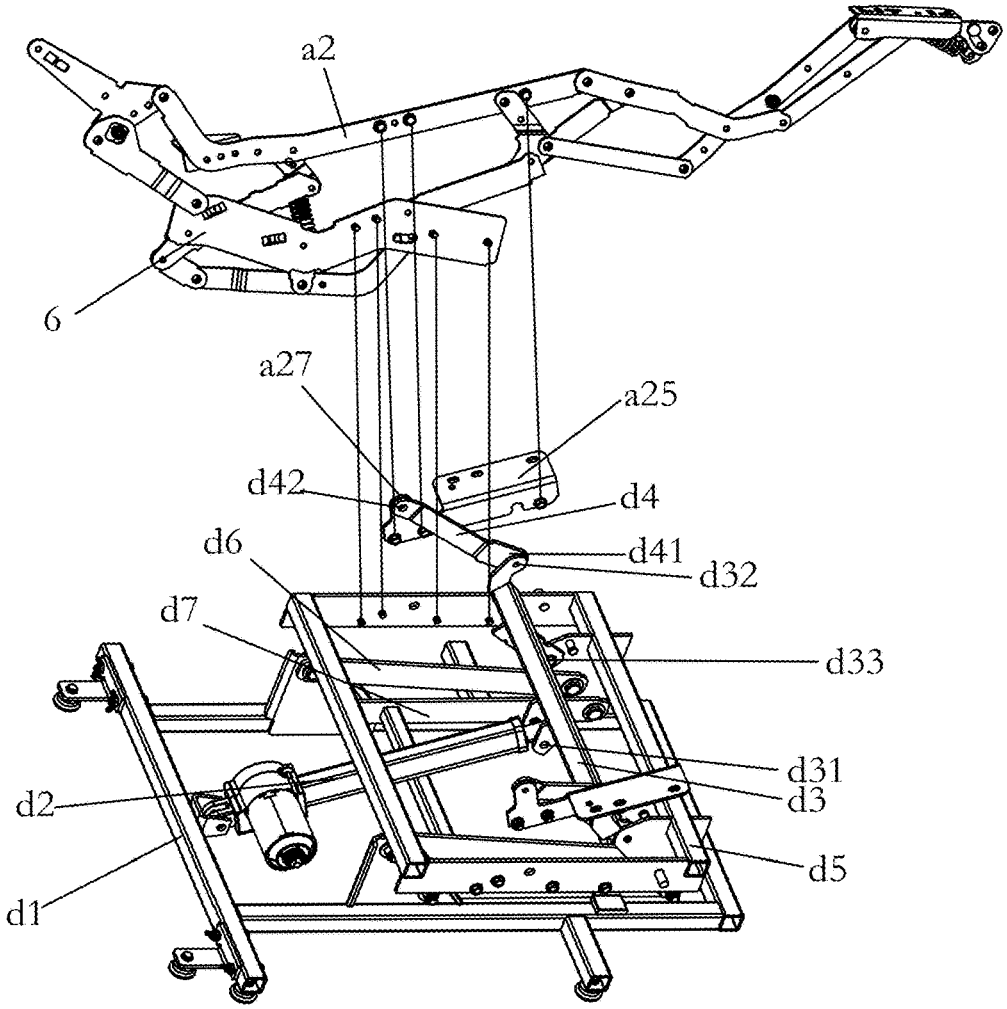
FIG. 9 is an explosive view of the chair in FIG. 8.
Figure 10:
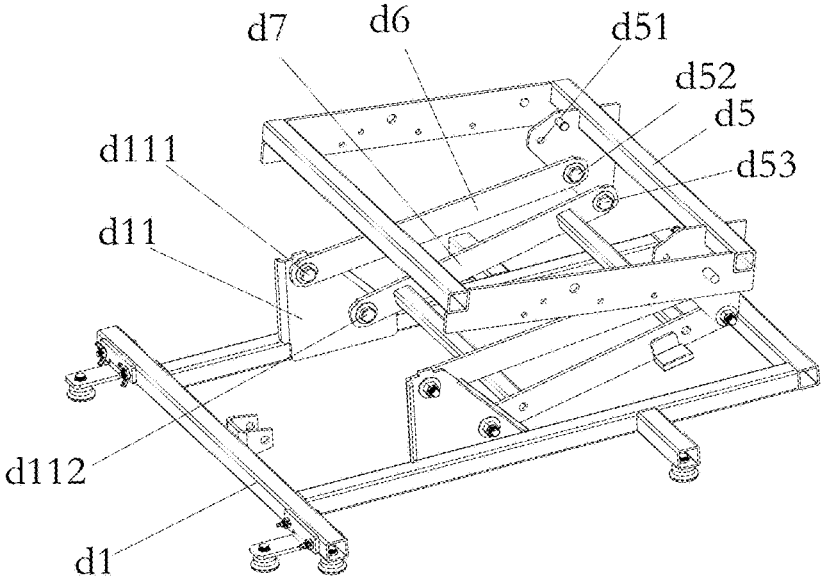
FIG. 10 is a stereo schematic diagram of a driving assembly in a first embodiment of the present disclosure, in which a third transmission member is raised.

Referring to FIG. 8-FIG. 10, the driving assembly d includes a pedestal d1, a linear actuator d2, a third transmission member d5, a first transmission member d3 and a second transmission member d4. It should be noted that in the present embodiment, the number of the linear actuator d2 is one.

In the present embodiment, the first transmission member d3 is provided with a forty-sixth rotating portion d31, a forty-eighth rotating portion d32 and a fifty-first rotating portion d33. The first transmission member d3 includes a long rod and three metal plates successively fixed on an outer surface of the long rod along an axis of the long rod. The forty-sixth rotating portion d31, the forty-eighth rotating portion d32 and the fifty-first rotating portion d33 are disposed on the three metal plates, respectively. The fifty-first rotating portion d33 is located between the forty-eighth rotating portion d32 and the forty-sixth rotating portion d31. The two ends of the linear actuator d2 are rotatably connected to the pedestal d1 and the forty-sixth rotating portion d31, respectively.

The bearing member a2 is provided with a forty-ninth rotating portion a27. In the present embodiment, an metal member a25 is fixed to the bearing member a2. The forty-ninth rotating portion a27 is disposed on the metal member a25. The second transmission member d4 is provided with a forty-seventh rotating portion d41 and a fiftieth rotating portion d42. The second transmission member d4 is rod-shaped. The forty-seventh rotating portion d41 and the fiftieth rotating portion d42 are disposed at two ends of the second transmission member d4, respectively. The forty-ninth rotating portion a27 is rotatably connected to the fiftieth rotating portion d42. The forty-seventh rotating portion d41 is rotatably connected to the forty-eighth rotating portion d32. In this way, the driving assembly d is in transmission connection with the supporting assembly a.

The third transmission member d5 is approximately frame-shaped. In the present embodiment, an edge of the third transmission member d5 is fixed on the sixth connecting member 6. The third transmission member d5 is provided with a fifty-second rotating portion d51, a fifty-fifth rotating portion d52 and a fifty-sixth rotating portion d53. In the present embodiment, the edge of the third transmission member d5 is fixed with a metal plate. The fifty-second rotating portion d51, the fifty-fifth rotating portion d52 and the fifty-sixth rotating portion d53 are all disposed on the metal plate, and the fifty-second rotating portion d51, the fifty-fifth rotating portion d52 and the fifty-sixth rotating portion d53 are spaced from each other. The fifty-fifth rotating portion d52 is located between the fifty-second rotating portion d51 and the fifty-sixth rotating portion d53. The fifty-first rotating portion d33 is rotatably connected to the fifty-second rotating portion d51. Therefore, the driving assembly d is in direct transmission connection with the transmission assembly.

Since a distance between the sixth connecting member 6 and the pedestal d1 will change when the chair is switched between different the unfolded states, the driving assembly d in the present embodiment further includes a first connecting rod d6 and a second connecting rod d7. A supporting plate d11 is fixed on the pedestal d1. The supporting plate d11 is provided with a fifty-third rotating portion d111 and a fifty-fourth rotating portion d112. Two ends of the first connecting rod d6 are rotatably connected to the fifty-third rotating portion d111 and the fifty-fifth rotating portion d52, respectively, and two ends of the second connecting rod d7 are rotatably connected to the fifty-fourth rotating portion d112 and the fifty-sixth rotating portion d53, respectively.

Figure 11:
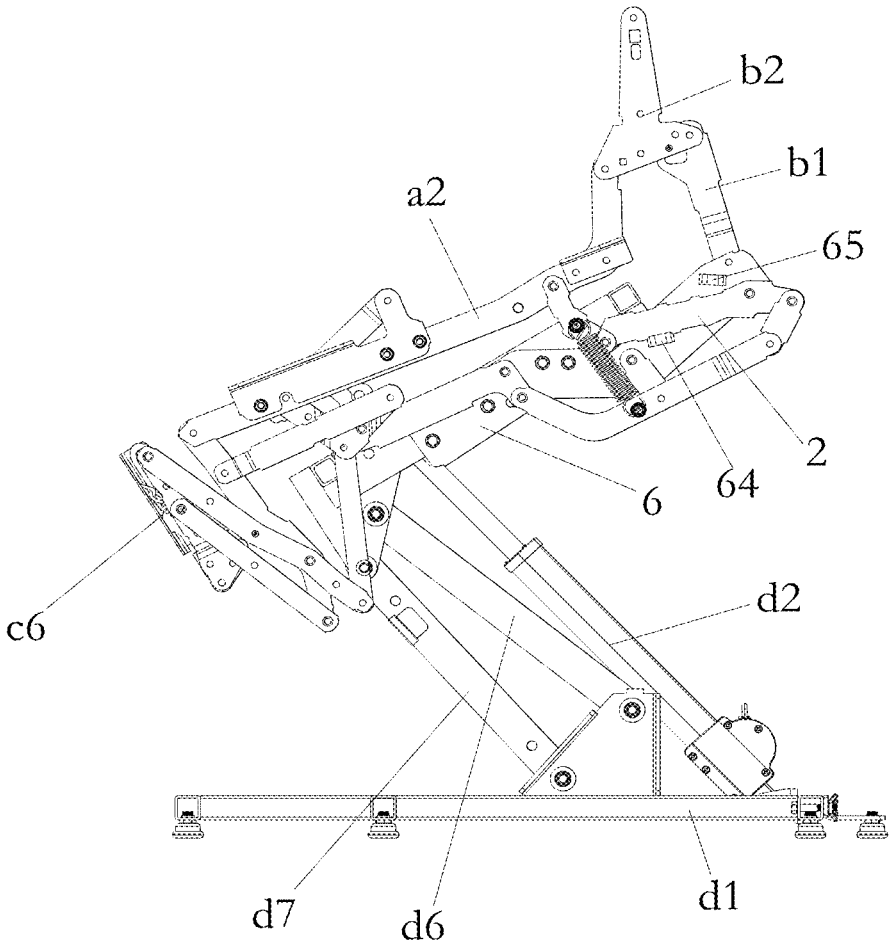
FIG. 11 is a front view of a chair (in a lifting state) in a first embodiment of the present disclosure.
Figure 15:
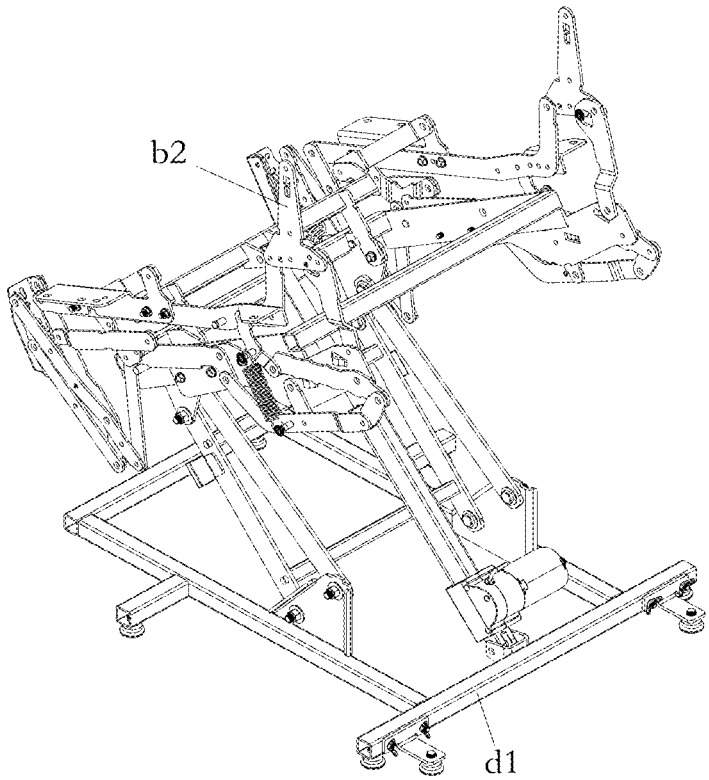
FIG. 15 is a stereo schematic diagram of a chair (in a lifting state) in a first embodiment of the present disclosure.

Referring to FIG. 11 and FIG. 15, when the chair is in the lifting state, the footrest assembly c retracted in a whole. The sixth connecting member 6 is inclined disposed relative to the pedestal d1, and the second connecting member 2 abuts against the first restricting piece 64.

Figure 12:
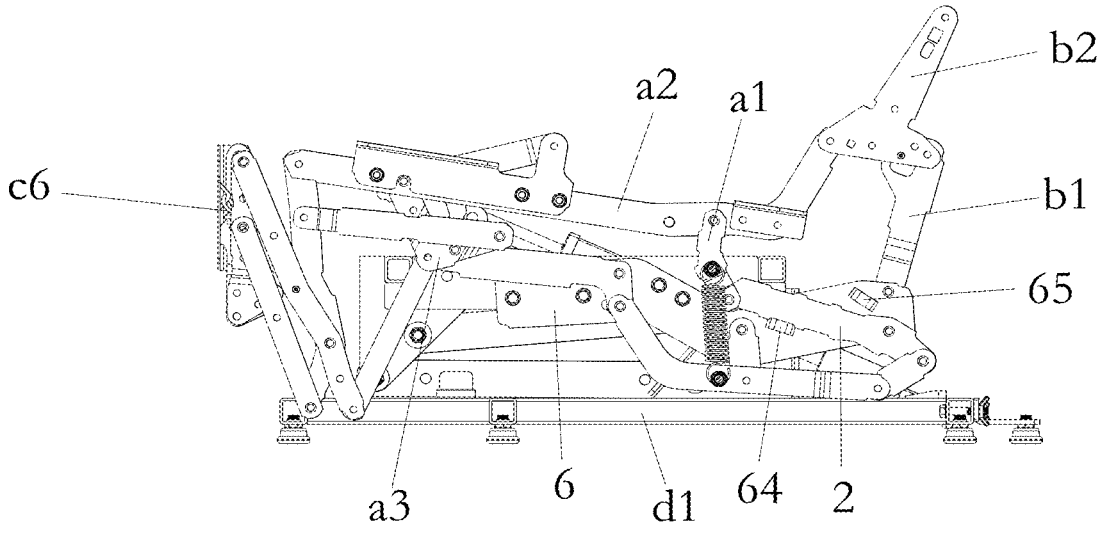
FIG. 12 is a front view of a chair (in a seating state) in a first embodiment of the present disclosure.
Figure 16:
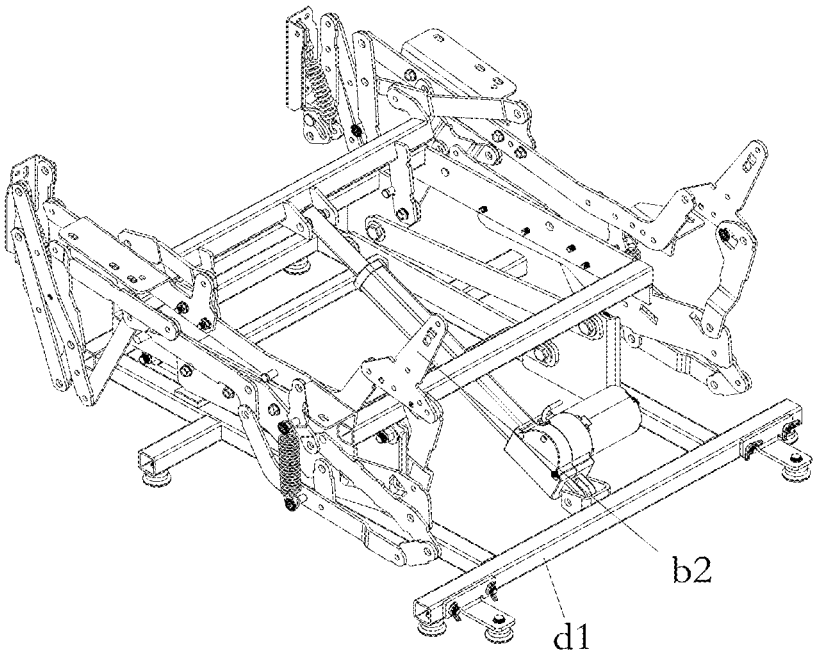
FIG. 16 is a stereo schematic diagram of a chair (in a seating state) in a first embodiment of the present disclosure.

Referring to FIG. 12 and FIG. 16, by shortening a length of the linear actuator d2, the sixth connecting member 6 is rotated, so that the chair can be switched from the lifting state to the seating state. At this time, the footrest assembly c is still in the retracted state, and the second connecting member 2 still abuts against the first restricting piece 64.

Figure 13:
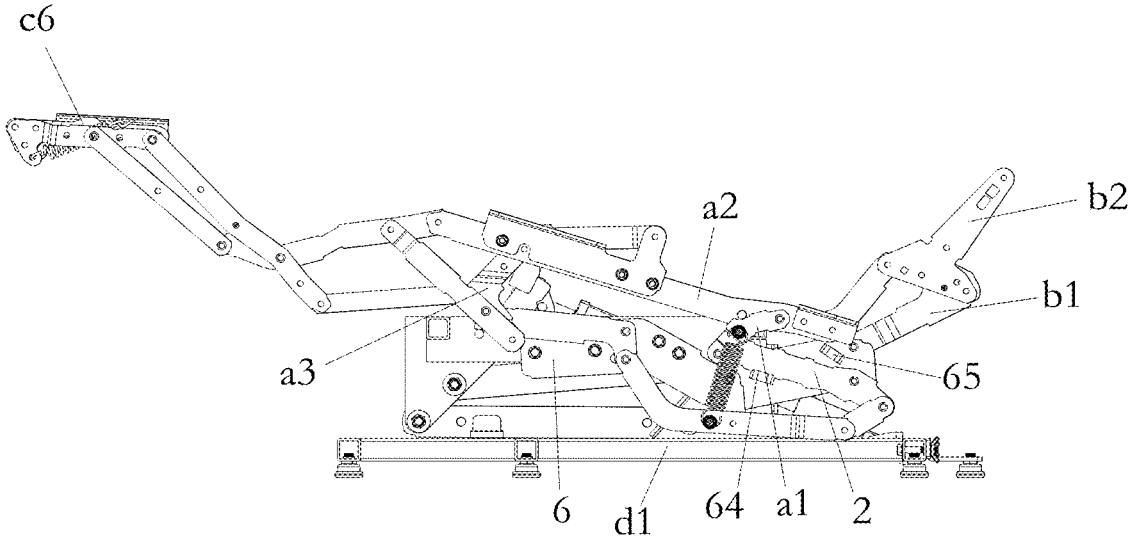
FIG. 13 is a front view of a chair (in a TV state) in a first embodiment of the present disclosure.

Referring to FIG. 13 and the FIG. 1, the length of the linear actuator d2 is further shortened, so that the bearing member a2 moves backward relative to the pedestal d1. At the same time, the first supporting member a1 and the second supporting member a3 are rotated, so that the footrest assembly c is switched to an opened state. Therefore, the chair is switched from the seating state to the TV state, and the second connecting member 2 still abuts against the first restricting piece 64 at this time.

Figure 14:
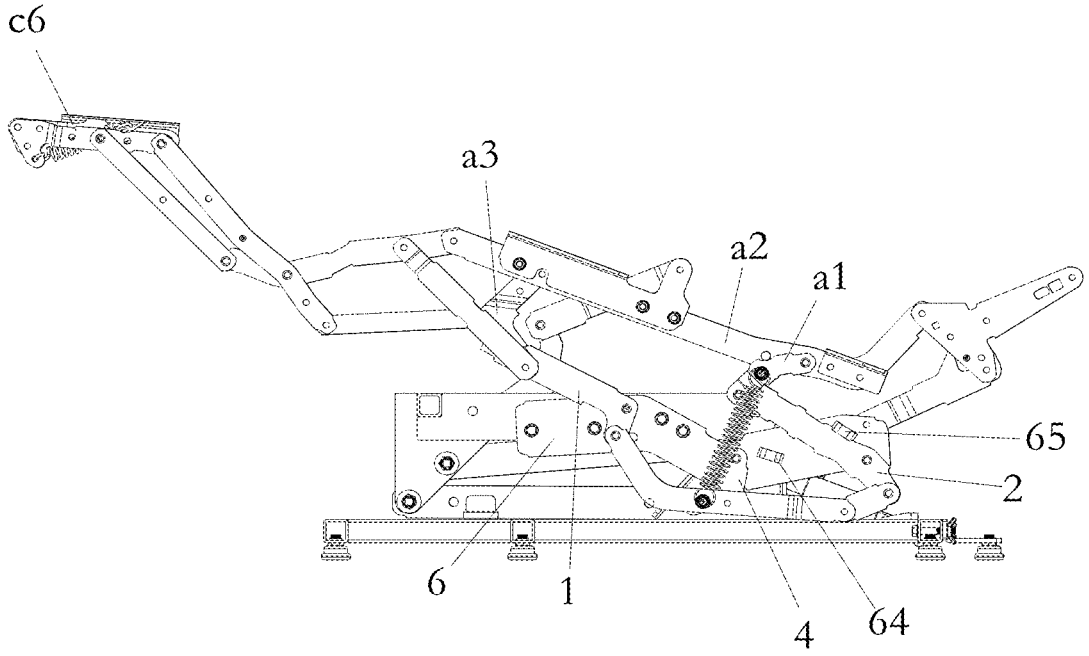
FIG. 14 is a front view of a chair (in a leisure state) in a first embodiment of the present disclosure.
Figure 17:
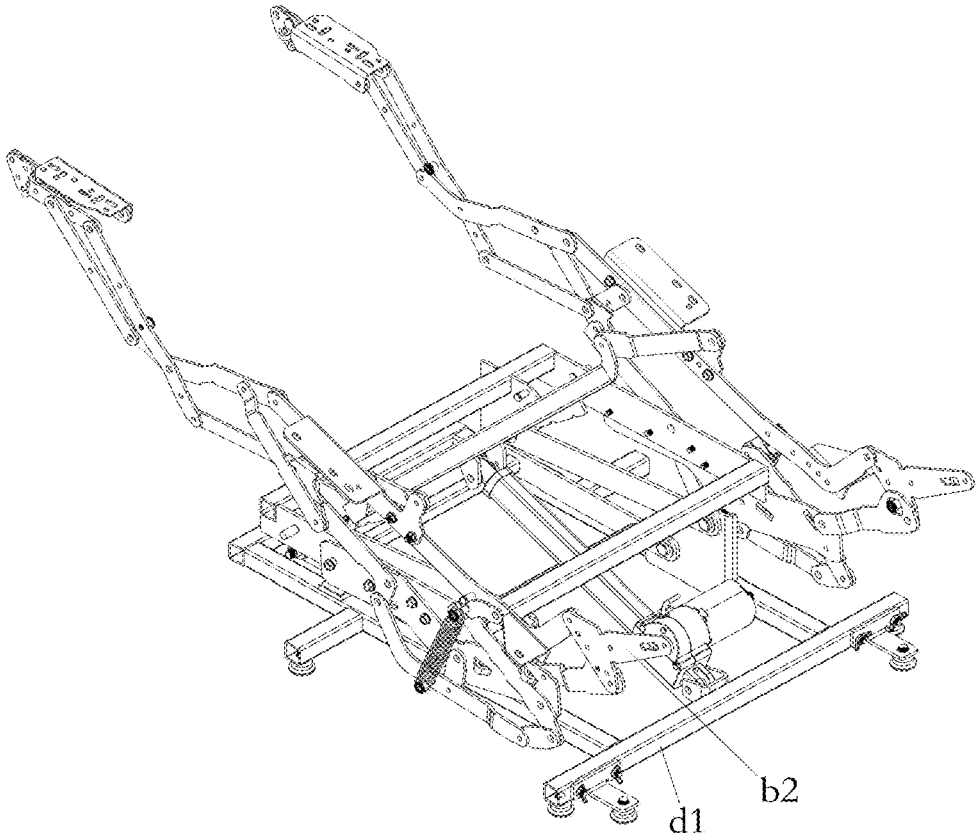
FIG. 17 is a stereo schematic diagram of a chair (in a leisure state) in a first embodiment of the present disclosure.

Referring to FIG. 14 and the FIG. 17, the length of the linear actuator d2 is shortened again, so that the second connecting member 2 abuts against the second restricting piece 65. The first connecting member 1, the second connecting member 2 and the fourth connecting member 4 are further rotated, so that chair is switched from the TV state to the leisure state.

Figure 18:
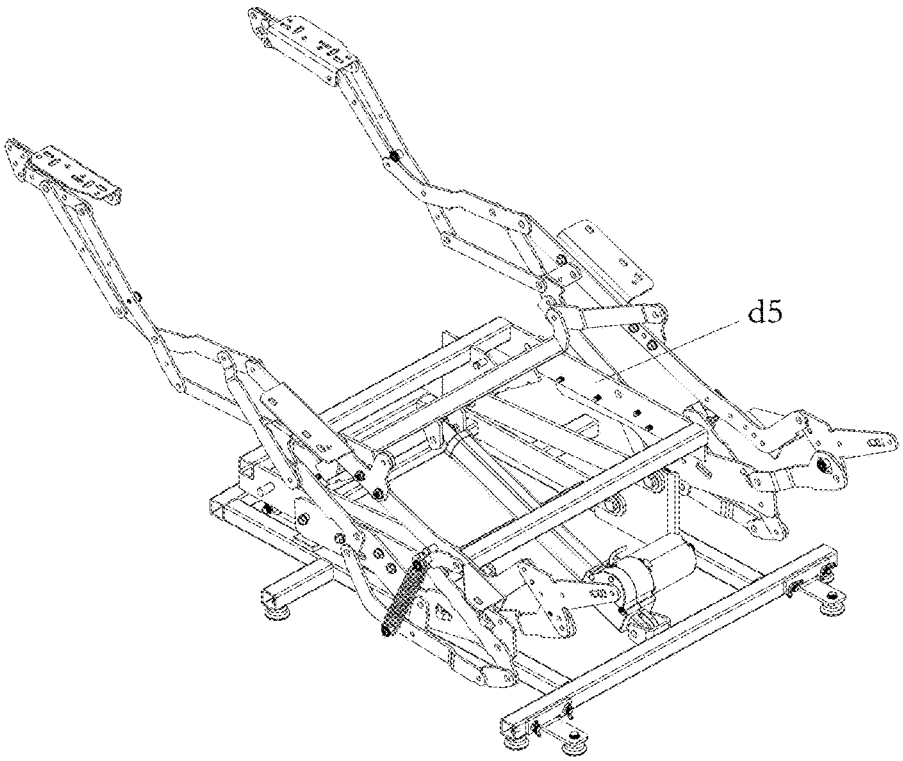
FIG. 18 is a stereo schematic diagram of a chair when the chair is horizontally disposed.
Figure 19:
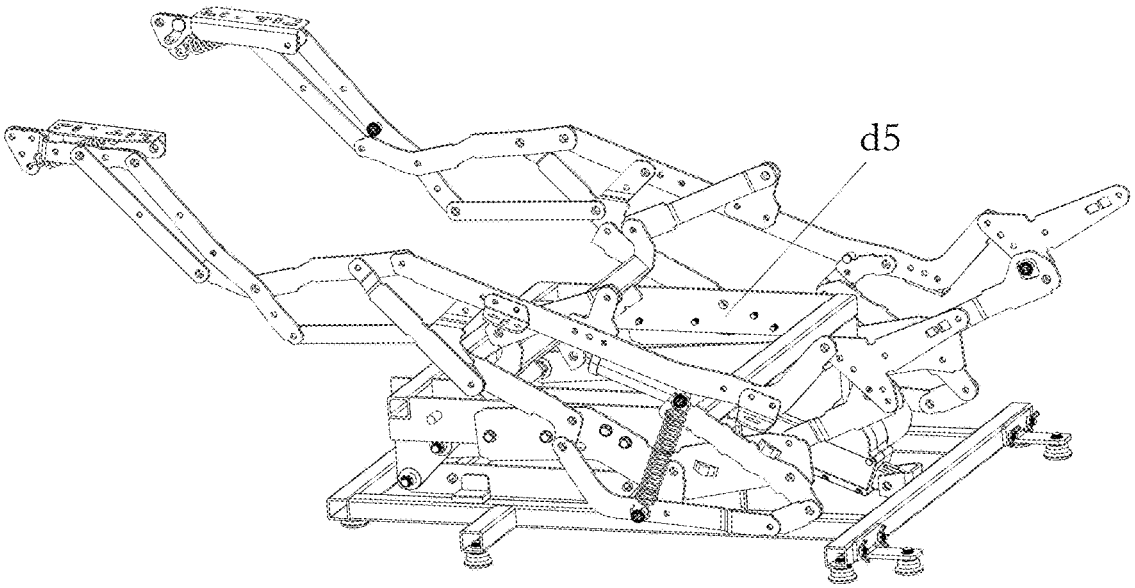
FIG. 19 is a stereo schematic diagram of a chair when the chair is vertically disposed.

Referring to FIG. 18 and the FIG. 19, the chair of in the first embodiment has two disposing methods: one is vertically disposed and the other is horizontally disposed.

Second Embodiment

Figure 20:
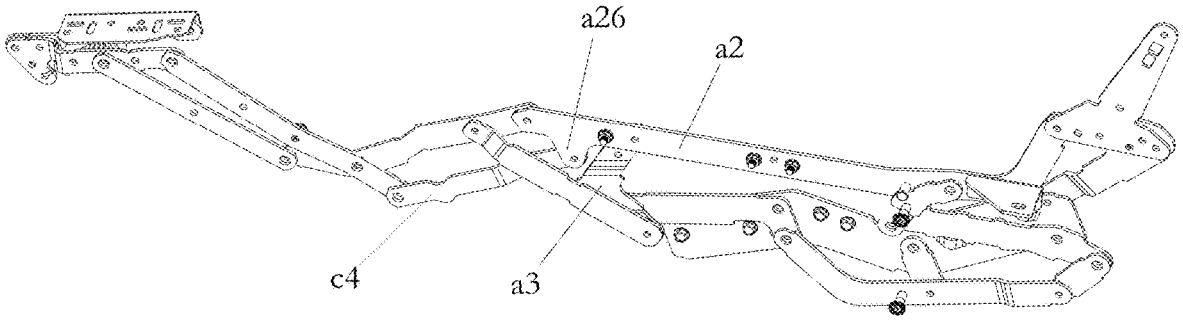
FIG. 20 shows an assembling relationship between a transmission assembly, a supporting assembly and a footrest assembly in a second embodiment of the present disclosure.

Referring to FIG. 20, the second embodiment provides a chair. The chair in the second embodiment is substantially the same as the chair in the first embodiment. A difference between the chair of the second embodiment and the chair of the first embodiment is in that: the bearing member a2 in the chair of the second embodiment is provided with a fifty-seventh rotating portion a26. The fortieth rotating portion of the fourth leg connecting member c4 is not rotatably connected to the forty-first rotating portion of the second supporting member a3, but the fortieth rotating portion of the fourth leg connecting member c4 is rotatably connected to the fifty-seventh rotating portion a26.

The mechanical extending mechanism and the chair of the present disclosure have following advantages.

Two pentagon-shaped connecting rod mechanisms and a rectangle-shaped connecting rod mechanism are defined by the first connecting member, the second connecting member, the third connecting member, the fourth connecting member, the fifth connecting member and the sixth connecting member, so that unfolded states of the mechanical extending mechanism can be switched by the driving assembly with only one linear actuator, and a production cost of the mechanical extending mechanism is lowered.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present disclosure.

The above-described embodiments are only several implementations of the present disclosure, and the descriptions are relatively specific and detailed, but they should not be construed as limiting the scope of the present disclosure. It should be understood by those of ordinary skill in the art that various modifications and improvements can be made without departing from the concept of the present disclosure, and all fall within the protection scope of the present disclosure. Therefore, the patent protection of the present disclosure shall be defined by the appended claims.

What is claimed is:

1. A mechanical extending mechanism, comprising a first connecting member, a second connecting member, a third connecting member, a fourth connecting member, a fifth connecting member and a sixth connecting member;

wherein the first connecting member is provided with a first rotating portion, the third connecting member is provided with a second rotating portion, and the first rotating portion is rotatably connected to the second rotating portion;

the third connecting member is provided with a third rotating portion, the fourth connecting member is provided with a fifth rotating portion, and the third rotating portion is rotatably connected to the fifth rotating portion;

the fourth connecting member is provided with a sixth rotating portion, the sixth connecting member is provided with a seventh rotating portion, and the sixth rotating portion is rotatably connected to the seventh rotating portion;

the sixth connecting member is provided with an eighth rotating portion, the first connecting member is provided with a ninth rotating portion, and the eighth rotating portion is rotatably connected to the ninth rotating portion;

the fifth connecting member is provided with a tenth connecting portion, the third connecting member is provided with an eleventh connecting portion, and the tenth connecting portion is rotatably connected to the eleventh connecting portion;

the fifth connecting member is provided with a twelfth connecting portion, the second connecting member is provided with a thirteenth connecting portion, and the twelfth connecting portion is rotatably connected to the thirteenth connecting portion; and the second connecting member is provided with a fourteenth connecting portion, the sixth connecting member is provided with a fifteenth connecting portion, and the fourteenth connecting portion is rotatably connected to the fifteenth connecting portion.

2. The mechanical extending mechanism of claim 1, further comprising a supporting assembly, wherein the supporting assembly comprises a first supporting member, a bearing member and a second supporting member;

the second connecting member is provided with a sixteenth rotating portion, the first supporting member is provided with a seventeenth rotating portion, and the sixteenth rotating portion is rotatably connected to the seventeenth rotating portion;

the first supporting member is provided with an eighteenth rotating portion, the bearing member is provided with a nineteenth rotating portion, and the eighteenth rotating portion is rotatably connected to the nineteenth rotating portion;

the bearing member is provided with a twentieth rotating portion, the second supporting member is provided with a twenty-first rotating portion, and the twentieth rotating portion is rotatably connected to the twenty-first rotating portion; and the second supporting member is provided with a twenty-second rotating portion, the first connecting member is provided with a twenty-third rotating portion, and the twenty-second rotating portion is rotatably connected to the twenty-third rotating portion.

3. The mechanical extending mechanism of claim 2, further comprising a backrest assembly, wherein the backrest assembly comprises a first backrest connecting member and a second backrest connecting member;

the sixth connecting member is provided with a twenty-fourth rotating portion, the first backrest connecting member is provided with a twenty-fifth rotating portion, and the twenty-fourth rotating portion is rotatably connected to the twenty-fifth rotating portion;

the first backrest connecting member is provided with a twenty-sixth rotating portion, the second backrest connecting member is provided with a twenty-seventh rotating portion, the twenty-sixth rotating portion is rotatably connected to the twenty-seventh rotating portion, one of the first backrest connecting member and the second backrest connecting member is provided with a restricting groove, and the other of the first backrest connecting member and the second backrest connecting member is restricted by the restricting groove to achieve a limited rotating angle; and the second backrest connecting member is provided with a twenty-eighth rotating portion, the bearing member is provided with a twenty-ninth rotating portion, and the twenty-eighth rotating portion is rotatably connected to the twenty-ninth rotating portion.

4. The mechanical extending mechanism of claim 2, further comprising a footrest assembly, wherein the footrest assembly comprises a first leg connecting member, a second leg connecting member, a third leg connecting member, a fourth leg connecting member, a fifth leg connecting member and a footrest member;

the first leg connecting member is provided with a thirtieth rotating portion, the bearing member is provided with a thirty-first rotating portion, and the thirtieth rotating portion is rotatably connected to the thirty-first rotating portion;

the second leg connecting member is provided with a thirty-second rotating portion, the first leg connecting member is provided with a thirty-third rotating portion, and the thirty-second rotating portion is rotatably connected to the thirty-third rotating portion;

the second leg connecting member is provided with a thirty-fourth rotating portion, the footrest member is provided with a thirty-fifth rotating portion, and the thirty-fourth rotating portion is rotatably connected to the thirty-fifth rotating portion;

the third leg connecting member is provided with a thirty-sixth rotating portion, the footrest member is provided with a thirty-seventh rotating portion, and the thirty-sixth rotating portion is rotatably connected to the thirty-seventh rotating portion;

the third leg connecting member is provided with a thirty-eighth rotating portion, the fourth leg connecting member is provided with a thirty-ninth rotating portion, and the thirty-eighth rotating portion is rotatably connected to the thirty-ninth rotating portion;

the fourth leg connecting member is provided with a fortieth rotating portion, the second supporting member is provided with a forty-first rotating portion, and the fortieth rotating portion is rotatably connected to the forty-first rotating portion;

the first leg connecting member is provided with a forty-second rotating portion, the fifth leg connecting member is provided with a forty-third rotating portion, and the forty-second rotating portion is rotatably connected to the forty-third rotating portion;

the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

5. The mechanical extending mechanism of claim 2, further comprising a driving assembly, wherein the driving assembly comprises a pedestal, a linear actuator, a first transmission member and a second transmission member;

the first transmission member is provided with a forty-sixth rotating portion, and both ends of the linear actuator are rotatably connected to the pedestal and the forty-sixth rotating portion, respectively;

the second transmission member is provided with a forty-seventh rotating portion, the first transmission member is provided with a forty-eighth rotating portion, and the forty-seventh rotating portion is rotatably connected to the forty-eighth rotating portion; and the bearing member is provided with a forty-ninth rotating portion, the second transmission member is provided with a fiftieth rotating portion, and the forty-ninth rotating portion is rotatably connected to the fiftieth rotating portion.

6. The mechanical extending mechanism of claim 5, wherein the driving assembly further comprises a third transmission member fixed to the sixth connecting member; and the first transmission member is provided with a fifty-first rotating portion, the third transmission member is provided with a fifty-second rotating portion, and the fifty-first rotating portion is rotatably connected to the fifty-second rotating portion.

7. The mechanical extending mechanism of claim 6, wherein a supporting plate is fixed to the pedestal, the supporting plate is provided with a fifty-third rotating portion and a fifty-fourth rotating portion, and the third transmission member is provided with a fifty-fifth rotating portion and a fifty-sixth rotating portion; and the driving assembly further comprises a first connecting rod and a second connecting rod, both ends of the first connecting rod are rotatably connected to the fifty-third rotating portion and the fifty-fifth rotating portion, respectively, and both ends of the second connecting rod are rotatably connected to the fifty-fourth rotating portion and the fifty-sixth rotating portion, respectively.

8. The mechanical extending mechanism of claim 2, further comprising a footrest assembly, wherein the footrest assembly comprises a first leg connecting member, a second leg connecting member, a third leg connecting member, a fourth leg connecting member, a fifth leg connecting member and a footrest member;

the first leg connecting member is provided with a thirtieth rotating portion, the bearing member is provided with a thirty-first rotating portion, and the thirtieth rotating portion is rotatably connected to the thirty-first rotating portion;

the second leg connecting member is provided with a thirty-second rotating portion, the first leg connecting member is provided with a thirty-third rotating portion, and the thirty-second rotating portion is rotatably connected to the thirty-third rotating portion;

the second leg connecting member is provided with a thirty-fourth rotating portion, the footrest member is provided with a thirty-fifth rotating portion, and the thirty-fourth rotating portion is rotatably connected to the thirty-fifth rotating portion;

the third leg connecting member is provided with a thirty-sixth rotating portion, the footrest member is provided with a thirty-seventh rotating portion, and the thirty-sixth rotating portion is rotatably connected to the thirty-seventh rotating portion;

the third leg connecting member is provided with a thirty-eighth rotating portion, the fourth leg connecting member is provided with a thirty-ninth rotating portion, and the thirty-eighth rotating portion is rotatably connected to the thirty-ninth rotating portion;

the fourth leg connecting member is provided with a fortieth rotating portion, the bearing member is provided with a fifty-seventh rotating portion, and the fortieth rotating portion is rotatably connected to the fifty-seventh rotating portion;

the first leg connecting member is provided with a forty-second rotating portion, the fifth leg connecting member is provided with a forty-third rotating portion, and the forty-second rotating portion is rotatably connected to the forty-third rotating portion;

the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

9. The mechanical extending mechanism of claim 1, wherein the sixth connecting member is provided with a first restricting piece and a second restricting piece, at least part of the second connecting member is located between the first restricting piece and the second restricting piece, and the first restricting piece and the second restricting piece are configured for restricting the second connecting member.

10. A chair, comprising the mechanical extending mechanism of claim 1, wherein the mechanical extending mechanism comprises a first connecting member, a second connecting member, a third connecting member, a fourth connecting member, a fifth connecting member and a sixth connecting member;

wherein the first connecting member is provided with a first rotating portion, the third connecting member is provided with a second rotating portion, and the first rotating portion is rotatably connected to the second rotating portion;

the third connecting member is provided with a third rotating portion, the fourth connecting member is provided with a fifth rotating portion, and the third rotating portion is rotatably connected to the fifth rotating portion;

the fourth connecting member is provided with a sixth rotating portion, the sixth connecting member is provided with a seventh rotating portion, and the sixth rotating portion is rotatably connected to the seventh rotating portion;

the sixth connecting member is provided with an eighth rotating portion, the first connecting member is provided with a ninth rotating portion, and the eighth rotating portion is rotatably connected to the ninth rotating portion;

the fifth connecting member is provided with a tenth connecting portion, the third connecting member is provided with an eleventh connecting portion, and the tenth connecting portion is rotatably connected to the eleventh connecting portion;

the fifth connecting member is provided with a twelfth connecting portion, the second connecting member is provided with a thirteenth connecting portion, and the twelfth connecting portion is rotatably connected to the thirteenth connecting portion; and the second connecting member is provided with a fourteenth connecting portion, the sixth connecting member is provided with a fifteenth connecting portion, and the fourteenth connecting portion is rotatably connected to the fifteenth connecting portion.

11. The chair of claim 10, further comprising a supporting assembly, wherein the supporting assembly comprises a first supporting member, a bearing member and a second supporting member;

the second connecting member is provided with a sixteenth rotating portion, the first supporting member is provided with a seventeenth rotating portion, and the sixteenth rotating portion is rotatably connected to the seventeenth rotating portion;

the first supporting member is provided with an eighteenth rotating portion, the bearing member is provided with a nineteenth rotating portion, and the eighteenth rotating portion is rotatably connected to the nineteenth rotating portion;

the bearing member is provided with a twentieth rotating portion, the second supporting member is provided with a twenty-first rotating portion, and the twentieth rotating portion is rotatably connected to the twenty-first rotating portion; and the second supporting member is provided with a twenty-second rotating portion, the first connecting member is provided with a twenty-third rotating portion, and the twenty-second rotating portion is rotatably connected to the twenty-third rotating portion.

12. The chair of claim 11, further comprising a backrest assembly, wherein the backrest assembly comprises a first backrest connecting member and a second backrest connecting member;

the sixth connecting member is provided with a twenty-fourth rotating portion, the first backrest connecting member is provided with a twenty-fifth rotating portion, and the twenty-fourth rotating portion is rotatably connected to the twenty-fifth rotating portion;

the first backrest connecting member is provided with a twenty-sixth rotating portion, the second backrest connecting member is provided with a twenty-seventh rotating portion, the twenty-sixth rotating portion is rotatably connected to the twenty-seventh rotating portion, one of the first backrest connecting member and the second backrest connecting member is provided with a restricting groove, and the other of the first backrest connecting member and the second backrest connecting member is restricted by the restricting groove to achieve a limited rotating angle; and the second backrest connecting member is provided with a twenty-eighth rotating portion, the bearing member is provided with a twenty-ninth rotating portion, and the twenty-eighth rotating portion is rotatably connected to the twenty-ninth rotating portion.

13. The chair of claim 11, further comprising a footrest assembly, wherein the footrest assembly comprises a first leg connecting member, a second leg connecting member, a third leg connecting member, a fourth leg connecting member, a fifth leg connecting member and a footrest member;

the first leg connecting member is provided with a thirtieth rotating portion, the bearing member is provided with a thirty-first rotating portion, and the thirtieth rotating portion is rotatably connected to the thirty-first rotating portion;

the second leg connecting member is provided with a thirty-second rotating portion, the first leg connecting member is provided with a thirty-third rotating portion, and the thirty-second rotating portion is rotatably connected to the thirty-third rotating portion;

the second leg connecting member is provided with a thirty-fourth rotating portion, the footrest member is provided with a thirty-fifth rotating portion, and the thirty-fourth rotating portion is rotatably connected to the thirty-fifth rotating portion;

the third leg connecting member is provided with a thirty-sixth rotating portion, the footrest member is provided with a thirty-seventh rotating portion, and the thirty-sixth rotating portion is rotatably connected to the thirty-seventh rotating portion;

the third leg connecting member is provided with a thirty-eighth rotating portion, the fourth leg connecting member is provided with a thirty-ninth rotating portion, and the thirty-eighth rotating portion is rotatably connected to the thirty-ninth rotating portion;

the fourth leg connecting member is provided with a fortieth rotating portion, the second supporting member is provided with a forty-first rotating portion, and the fortieth rotating portion is rotatably connected to the forty-first rotating portion;

the first leg connecting member is provided with a forty-second rotating portion, the fifth leg connecting member is provided with a forty-third rotating portion, and the forty-second rotating portion is rotatably connected to the forty-third rotating portion;

the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

14. The chair of claim 11, further comprising a driving assembly, wherein the driving assembly comprises a pedestal, a linear actuator, a first transmission member and a second transmission member;

the first transmission member is provided with a forty-sixth rotating portion, and both ends of the linear actuator are rotatably connected to the pedestal and the forty-sixth rotating portion, respectively;

the second transmission member is provided with a forty-seventh rotating portion, the first transmission member is provided with a forty-eighth rotating portion, and the forty-seventh rotating portion is rotatably connected to the forty-eighth rotating portion; and the bearing member is provided with a forty-ninth rotating portion, the second transmission member is provided with a fiftieth rotating portion, and the forty-ninth rotating portion is rotatably connected to the fiftieth rotating portion.

15. The chair of claim 14, wherein the driving assembly further comprises a third transmission member fixed to the sixth connecting member; and the first transmission member is provided with a fifty-first rotating portion, the third transmission member is provided with a fifty-second rotating portion, and the fifty-first rotating portion is rotatably connected to the fifty-second rotating portion.

16. The chair of claim 15, wherein a supporting plate is fixed to the pedestal, the supporting plate is provided with a fifty-third rotating portion and a fifty-fourth rotating portion, and the third transmission member is provided with a fifty-fifth rotating portion and a fifty-sixth rotating portion; and the driving assembly further comprises a first connecting rod and a second connecting rod, both ends of the first connecting rod are rotatably connected to the fifty-third rotating portion and the fifty-fifth rotating portion, respectively, and both ends of the second connecting rod are rotatably connected to the fifty-fourth rotating portion and the fifty-sixth rotating portion, respectively.

17. The chair of claim 11, further comprising a footrest assembly, wherein the footrest assembly comprises a first leg connecting member, a second leg connecting member, a third leg connecting member, a fourth leg connecting member, a fifth leg connecting member and a footrest member;

the first leg connecting member is provided with a thirtieth rotating portion, the bearing member is provided with a thirty-first rotating portion, and the thirtieth rotating portion is rotatably connected to the thirty-first rotating portion;

the second leg connecting member is provided with a thirty-second rotating portion, the first leg connecting member is provided with a thirty-third rotating portion, and the thirty-second rotating portion is rotatably connected to the thirty-third rotating portion;

the second leg connecting member is provided with a thirty-fourth rotating portion, the footrest member is provided with a thirty-fifth rotating portion, and the thirty-fourth rotating portion is rotatably connected to the thirty-fifth rotating portion;

the third leg connecting member is provided with a thirty-sixth rotating portion, the footrest member is provided with a thirty-seventh rotating portion, and the thirty-sixth rotating portion is rotatably connected to the thirty-seventh rotating portion;

the third leg connecting member is provided with a thirty-eighth rotating portion, the fourth leg connecting member is provided with a thirty-ninth rotating portion, and the thirty-eighth rotating portion is rotatably connected to the thirty-ninth rotating portion;

the fourth leg connecting member is provided with a fortieth rotating portion, the bearing member is provided with a fifty-seventh rotating portion, and the fortieth rotating portion is rotatably connected to the fifty-seventh rotating portion;

the first leg connecting member is provided with a forty-second rotating portion, the fifth leg connecting member is provided with a forty-third rotating portion, and the forty-second rotating portion is rotatably connected to the forty-third rotating portion;

the fifth leg connecting member is provided with a forty-fourth rotating portion, the second supporting member is provided with a forty-fifth rotating portion, and the forty-fourth rotating portion is rotatably connected to the forty-fifth rotating portion; and the first leg connecting member is provided with a fifty-eighth rotating portion, the third leg connecting member is provided with a fifty-ninth rotating portion, and the fifty-eighth rotating portion is rotatably connected to the fifty-ninth rotating portion.

18. The chair of claim 10, wherein the sixth connecting member is provided with a first restricting piece and a second restricting piece, at least part of the second connecting member is located between the first restricting piece and the second restricting piece, and the first restricting piece and the second restricting piece are configured for restricting the second connecting member.

* * * * *